United States Patent [19]

Buchsteiner

[11] 4,212,400

[45] Jul. 15, 1980

[54] STAND FOR HOLDING UTENSILS TO BE DRIED

[75] Inventor: Renate Buchsteiner, Gingen, Fed. Rep. of Germany

[73] Assignee: Johannes Buchsteiner GmbH & Co KG, Gingen, Fed. Rep. of Germany

[21] Appl. No.: 902,266

[22] Filed: May 2, 1978

[30] Foreign Application Priority Data

Dec. 13, 1977 [DE] Fed. Rep. of Germany ... 7737937[U]

[51] Int. Cl.[2] ..... A47F 7/00

[52] U.S. Cl. ..... 211/41; 211/200

[58] Field of Search ..... 211/41, 40, 200, 13, 211/195; D7/188

[56] References Cited

U.S. PATENT DOCUMENTS

| | | | |
|---|---|---|---|
| D. 33,504 | 11/1900 | O'Brien | D7/188 |
| D. 247,416 | 3/1978 | Berman et al. | D7/188 |
| 2,958,424 | 11/1960 | Bigatti | 211/41 |

FOREIGN PATENT DOCUMENTS

| | | | |
|---|---|---|---|
| 21396 | 10/1946 | Finland | 211/41 |
| 730779 | 8/1932 | France | 211/41 |
| 185393 | 7/1936 | Switzerland | 211/41 |

*Primary Examiner*—Roy D. Frazier
*Assistant Examiner*—Robert W. Gibson, Jr.
*Attorney, Agent, or Firm*—Michael J. Striker

[57] ABSTRACT

A stand, particularly for holding utensils to be dried has two plate-like members pivotally connected with one another in a scissor-like manner and pivotable about an axis between an open position so as to assume a rack shape and a closed position. Each of the members has an upper portion located above the axis and adapted in the open position to support utensils to be dried, and a lower portion located below the axis and adapted to support the stand in at least the open position. The lower portion of each of the members has a lower end region, a supporting section extending from the lower end region toward the axis and adapted to support utensils to be dried, and a holding section extending from the supporting section in the lower end region at an angle relative to the supporting section so as to prevent utensils supported by the supporting section from sliding off the latter.

40 Claims, 6 Drawing Figures

13
44
IV
23
19
34
27
16
38
29
26
49
III
18
42
12
22
20
45
46
43
VI
VII
37
33
14
17
32
35
30
39
41
10
11
28

STAND FOR HOLDING UTENSILS TO BE DRIED

BACKGROUND OF THE INVENTION

The present invention relates to a stand, particularly for holding utensils to be dried.

Stands for holding utensils to be dried have been proposed in the art. A stand of a known type has two plate-like members pivotally connected with one another in a scissor-like manner and pivotable about an axis between an open position so as to assume a rack shape, and a closed position. Each of the members has a lower portion located below the axis and adapted to support the stand, and an upper portion located above the axis and adapted in the open position to support utensils to be dried. The upper portions have a plurality of slots for inserting utensils therein, and the slots of the upper portion of one of the members coincide with the slots of the upper portion of another of the members. The slots are upwardly and downwardly bounded by cross bars. The above-described stand is not satisfactory in some respects.

SUMMARY OF THE INVENTION

Accordingly, it is an object of the present invention to provide a stand, particularly for holding utensils to be dried, which has some advantages, as compared with the known stands. More particularly, it is an object of the present invention to provide a stand for holding utensils to be dried, which assumes in an open position a rack shape and provides for large space and many supporting surfaces for positioning and firmly holding the utensils to be dried.

Another object of the present invention is to provide a stand for holding utensils to be dried, which possesses the above-mentioned advantages, and may support many individual utensils of various types as well as has small dimensions, is compact, and in an inoperative position, can be folded so as to thereupon occupy a small space when it stands or is suspended in households.

A still another feature of the present invention is to provide a stand for holding utensils to be dried which, in addition to the above mentioned advantages, satisfies hygienic requirements, can be fast and simply cleaned, has attractive appearance, and requires small manufacturing expenditures and therefore the stand in accordance with the present invention is inexpensive.

In keeping with these objects, and with others which will become apparent hereinafter, one feature of the present invention, briefly stated, resides in a stand particularly for holding utensils to be dried, which has two plate-like members pivotally connected with one another in a scissor-like manner and pivotable about an axis between an open position and a closed position, in which a lower portion of each of the pivotable members has a supporting section extending from a lower end region thereof toward the axis and adapted to support utensils to be dried, and a holding section extending from the supporting section in the lower end region at an angle relative to the supporting section so as to prevent utensils supported by the supporting section from sliding off the latter.

Another feature of the present invention is that the supporting section of each of the pivotable members is formed as a perforated plate.

Still another feature of the present invention is that the holding portion is formed as a strip laterally projecting from a respective one of the supporting portions so as to form a V-shaped receiving recess, which strip may be solid or provided with a plurality of holes.

A further feature of the present invention is that an inner base line of the V-shaped recess substantially corresponds to a lower edge of the supporting portion. The supporting portion may have a plurality of holes which extend up to the inner base line of the V-shaped recess, so that no liquid can accumulate in the recess. A still further feature of the present invention is that each of the strips includes substantially right angle with respect to one of the supporting portions and has a lower surface adapted to stably support the stand in an upright manner in the closed position thereof.

A still further feature of the present invention is that an outer base line of the V-shaped recess is located in a lower end region of the supporting section and forms a supporting edge adapted to place the stand on the supporting surface and to support the stand on the latter in the open position.

In accordance with an additional feature of the present invention, each of the lower portions has two bars located at a respective axial end thereof, and each of the supporting sections is located between the bars. Each of the lower portions may also have two projecting legs each of which includes with a respective ones of the bars of the same lower portion an angle corresponding to the angle which is included between the supporting section and the holding section. In such construction each of the strips extends between the projecting legs of each of the lower portions.

A still additional feature of the present invention is that each of the legs projects downwardly beyond a respective one of the strips and has a lower surface adapted to be placed on a supporting surface to thereby stably support the stand in an upright manner in the closed position.

When the stand constructed in accordance with the present invention is in its open position, utensils to be dried such as cups, glasses, cuttlery and the like can be accommodated in the V-shaped recess. Dishes and the like flat utensils can be positioned in a successive order in the slots of the upper portions of the pivotable members. When the stand is in its open position so as to form a rack shape, it is very stable both when it is fully filled with the utensils to be dried, and when only small number of utensils is accommodated in the upper portions or in the V-shaped recess of the lower portions thereof. The above-mentioned stability of the stand is guaranteed by the feature of the present invention in accordance with which the projecting legs extend outwardly from the lateral bars of the lower portions. Since the supporting section formed as a perforated plate, and a holding section formed as a strip extend between the lateral bars of each of the lower portions of each of the pivotable members, the lower portions are reinforced so as to form an exclusively rigid structure which is able to withstand great loads.

A yet further feature of the present invention is that each of the strips forming the holding section of the respective lower portion of the pivotable members has a lower surface adapted to be placed on a supporting surface and to support the stand in an upright manner in the closed position thereof.

In accordance with a yet additional feature of the present invention, the projecting legs including an angle with the bars of each of the lower portions form supporting elements which can be placed on a supporting surface and support the stand in an upright manner in the closed position thereof.

In accordance with an advantageous feature of the present invention, each of the pivotable members of the stand is integral and constituted by a synthetic plastic material. In this case, the stand satisfies hygienic requirements, and can be fast and inexpensively cleaned. At the same time this provides for a possibility to produce the stand with an attractive appearance and with small manufacturing expenditures so that the stand is inexpensive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figures 1, 2:
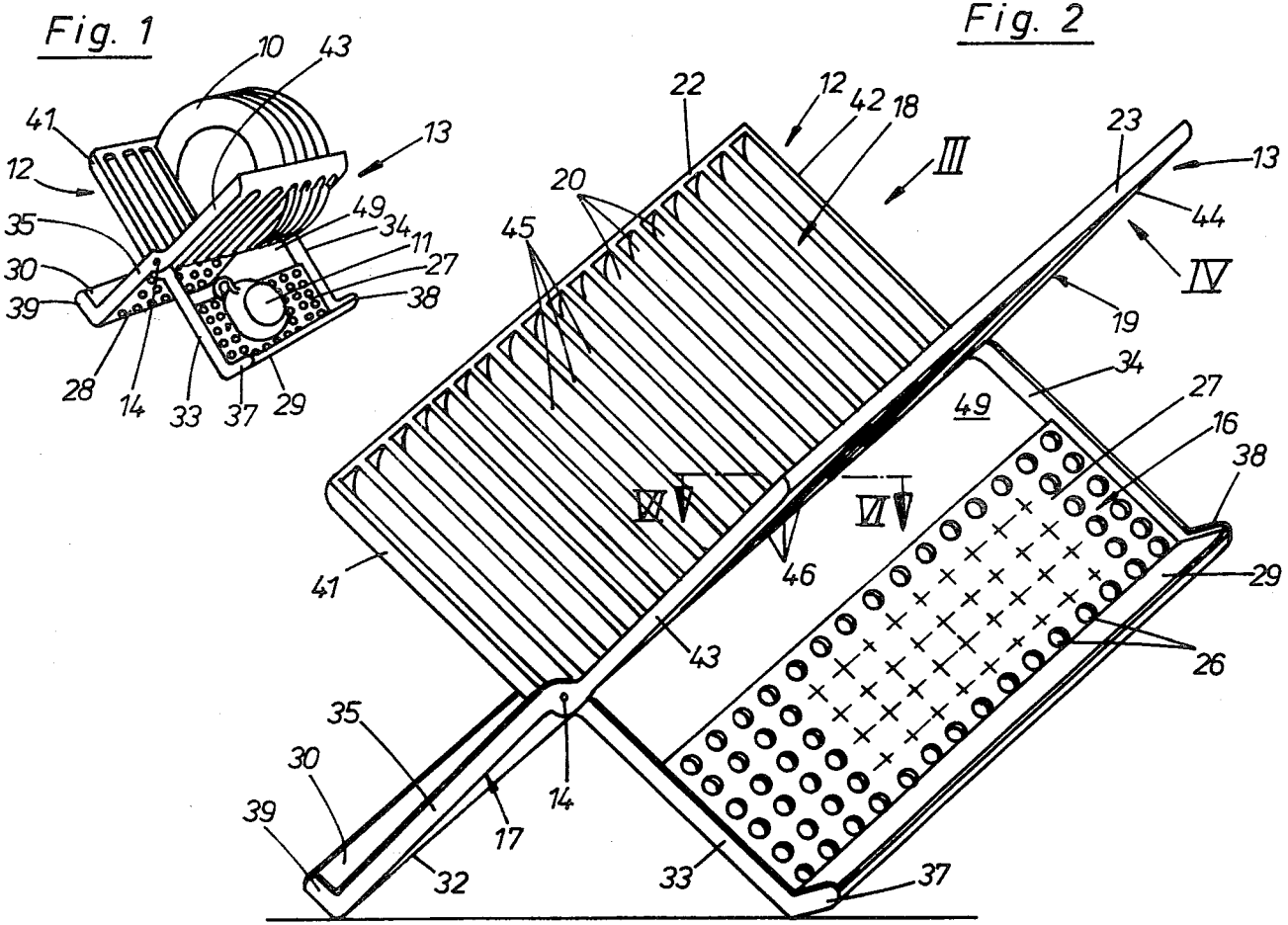
FIG. 1 is a schematic perspective view of a stand for holding utensils to be dried in accordance with the present invention in an open position with utensils accommodated therein.
FIG. 2 is a perspective enlarged view of the stand in the open position.

A stand shown in the drawing is utilized for holding utensils, such as dishes 10, cups 11, and the like, to be dried. The stand has two pivotable members 12 and 13 which are preferably integral and constituted by a synthetic plastic material. As shown in FIGS. 1 and 2, one of the members 12 extends from above left toward below right, whereas another member 13 extends substantially normal to the member 12 in an open position of the stand. The members 12 and 13 are pivotably connected with one another in a scissor-like manner by pivots so as to be pivoted about pivot axes 14 and 15. The thus-connected members 12 and 13 can be pivoted about the pivot axes 14 and 15 from one another to an open position so as to form a rack shape, and can be pivoted toward one another to a closed position of the stand.

Each of the members 12 and 13 has a lower portion 16 or 17, respectively, located below the pivot axes 14 or 15, and an upper portion 18 or 19 located above the pivot axes 14 and 15. Each of the upper portions 18 and 19 is lattice-like and has a plurality of slots 20 and 21, respectively, extending transverse to the pivot axes 14 and 15 and spaced from one another in an axial direction. A location of the slots 20 of the upper portion 18 corresponds to a location of the slots 21 of the upper portion 19 as considered in the axial direction. The slots 20 are bounded from above and from below by an upper cross bar 22 and a lower cross bar 23, respectively, and the slots 21 are bounded from above and from below by cross bars 24 and 25, respectively.

The lower portions 16 and 17 have supporting sections 27 and 28, respectively, located below the pivot axes 14 and 15 and extending toward the latter. The supporting sections are formed as perforated plates provided with a plurality of holes 26. Each of the perforated plates 27 and 28 has a strip 29 or 30, respectively, located at the lower end thereof. The strips 29 and 30 extend outwardly of the respective plates 27 or 28 and substantially normal relative to the latter so as to form a V-shaped recess. An inner base line of the V-shaped recess substantially corresponds to a lower edge of a respective one of the plates 27 and 28. The strips 29 and 30 prevent utensils to be dried, such as cups 11, glasses, cuttlery and the like, from sliding off the supporting plates 27 and 28.

The holes 26 of the plates 27 and 28 extend up to the inner base line of the V-shaped recess so that no liquid can accumulate in the recesses. In a closed position, the strips 29 and 30 of the pivotable members 12 and 13 form by their lower surfaces supporting surfaces for stably supporting the stand in an upright manner.

Figure 5:
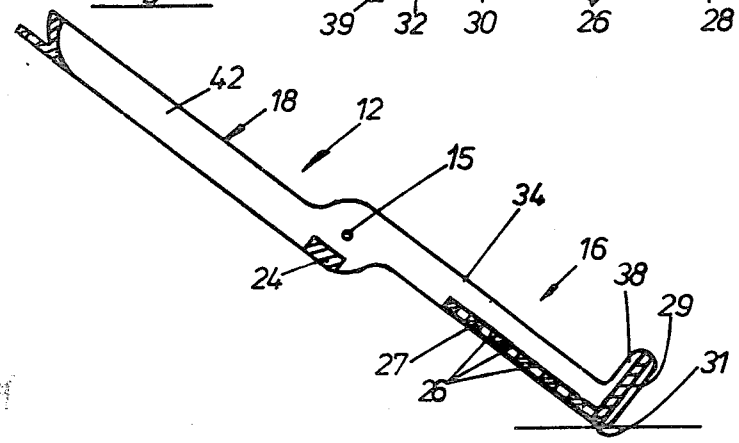
FIG. 5 is a view showing an enlarged schematic section taken on line V—V in FIG. 3.

Outer base lines 31 and 32 of the lower portions 16 or 17, which faces downwardly in FIGS. 1 and 2, are formed in lower edges of the lower portions so that when the stand is in its open position to form a rack shape, the lower portions 16 and 17 can be placed on a supporting surface and can support the stand, as specifically shown in FIG. 5.

Each of the lower portions 16 and 17 has bars 33 and 34 or 35 and 36 spaced from one another in the direction of the pivot axes 14 and 15. The plate 27 with the strip 29 extend between the bars 33 and 34. The plate 28 with the strip 30 extend between the bars 35 and 36. Each of the bars 33–36 is outwardly curved substantially by right angle and in a direction corresponding to a direction in which the strips 29 and 30 extend. Legs 37 and 38, as well as 39 and 40 are therefore formed in an end region of the bars 33 and 34, as well as 35 and 36, respectively. As can be seen from the drawing, the strip 29 extends between the legs 37 and 38, whereas the strip 30 extends between the legs 39 and 40.

The legs 37–40 project downwardly beyond the respective strips 29 and 30 so that in the closed position of the stand they can be placed on a supporting surface so as to stably support the stand in an upright manner. The bars 32–36 together with the legs 37–40 are formed as flat profiles which have a thickness dimensioned in the direction of the pivot axes 14 and 15.

Each of the strips 29 and 30 extends in a central plane of the legs 37 and 38 or 39 and 40, respectively. The plates 27 and 28 end in their lower edge substantially at a height at which inner edges of the flat bars 33 and 34 or 35 and 36 end. It is also possible that the first-mentioned edges are insignificantly outwardly spaced with respect to the second-mentioned edges.

Figure 4:
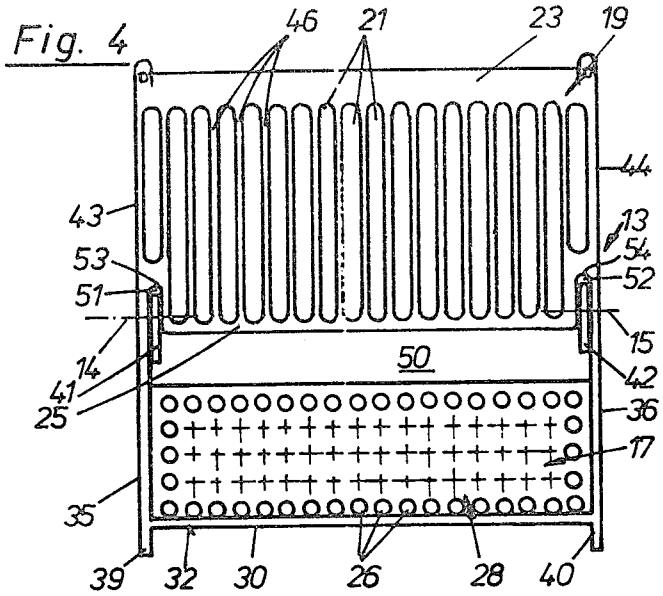
FIG. 4 is a side view of the right pivotable member as considered in FIG. 2, taken in direction of arrow IV in FIG. 2.
Figure 3:
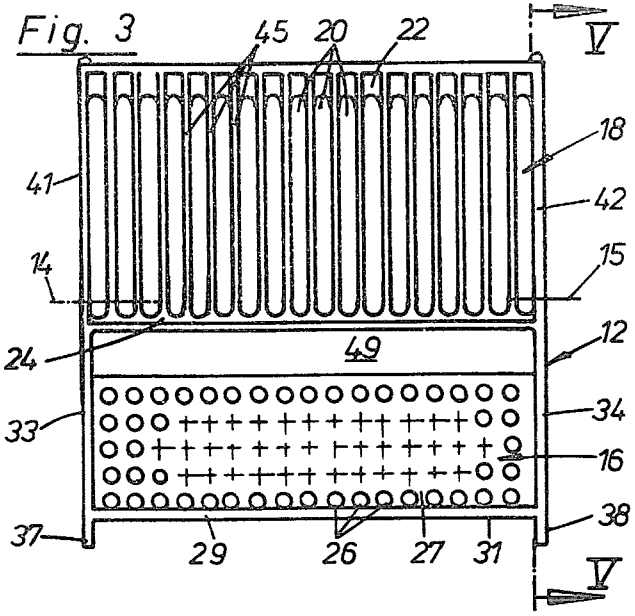
FIG. 3 is a side view of a left pivotable member as considered in FIG. 2, taken in direction of arrow III in FIG. 2.

The flat profiles 33–36 extend upwardly beyond the pivot axes 14 and 15 of the members 12 and 13 so as to form further bars 41 and 42 or 43 and 44 of the respective members 12 and 13. As shown in FIG. 3 in the upper portion 18 the upper cross bar 22 and the lower cross bar 24 extend between the left further bar 41 up to the right further bar 42. In the member 13 shown in FIG. 4, the upper cross-bar 23 similarly extends between the further bars 43 and 44. However, the lower cross bar 25 is shorter as compared with the upper cross bar 23 and terminates at a distance from the left further bar 43 and the right further bar 44.

A plurality of partitions 45 and 46 are formed in the upper portions 18 and 19, respectively, which partitions laterally bound the slots 20 and 21 from both sides thereof. The partitions 45 and 46 extend between the cross bars 22 and 24 or 23 and 25, respectively, and are formed as flat members. The partitions 25 and 26 have a width corresponding to the width of the further bars 41–44. Outer edges and inner edges of the partitions 45 and 46 coincide with those of the further bars 41–44.

Figure 6:
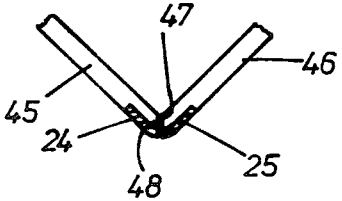
FIG. 6 is a schematic view showing a section taken in direction of arrows VI—VI in FIG. 2 of lower end portions of the pivotable members abutting against one another.

As can be particularly seen from FIG. 5 and FIG. 6, the cross bars 24 and 25 downwardly bounding the slots 20 and 21 are located at outer edges of the further bars 41–44 and the partitions 45 and 46. The partitions 45 and 44 terminate at their lower end as free standing ribs and are inclined so as to form bevels. The beveled edges 47 and 48 (FIG. 6) of the members 12 and 13 abut against one another in the open position of the stand so as to limit an angle by which the upper portions 18 and 19 are angularly spaced from one another in this position.

As shown in FIGS. 1, 2 and 5 and particularly in FIG. 5, the further bars 41–44 and the respective partitions 45 and 46 of each upper portion 18 and 19 are outwardly offset relative to the respective bars 33–36 of the lower portions 16 and 17 by a distance corresponding to their width. In this case, in the closed position of the stand, the inner edges of the further bars 41 and 42 and the partitions 45 of the upper portion 18 of the member 12 are substantially parallel to the inner edges of the further bars 43 and 44 and the partitions 46 of the other upper portion 19 of the member 12 and abut against the latter substantially without play. Therefore, the pivotable members 18 and 19 in the closed position are located parallel to and sealingly engage one another.

In the region of the pivot axes 14 and 15 each of the bars 34 (FIG. 5) and the further bars 42 are substantially Z-shaped and have a width exceeding the width of a remainder portion thereof. Thereby, the above-described full pivotability of the members without play is attained.

As can be seen from FIG. 2, the member 12 extending from above left toward below right is mounted pivotably about the pivot axes 14 and 15 and within the other member 13 between the bars 35, 36 and the further bars 43 and 44 of the latter.

Each of the members 12 and 13 is so constructed that free spaces 49 and 50 are provided between the upper edge of the plates 27 and 28 and the inner edge of the lower cross bars 24 and 25. The member 12 extends through the space provided in the member 13. In this case, both members 12 and 13 are easily inserted in and connected with one another. The member 13 in which the member 12 is received has slots 51 and 52 formed between the further bars 43 and 44, on the one hand, and the lower cross bar 25, on the other hand, in the region of the pivot axes 14 and 15. The left further bar 41 engages in the slot 51, whereas the right further bar 42 engages in the slot 52. Both the above-mentioned slots 51 and 52 are bounded from above by transverse abutment sections 53 and 54, respectively. In the open position of the stand the left further bar 41 and the right further bar 42 abut against the abutment sections 43 and 44, respectively, so as to limit the angle by which the upper portions of the members 12 and 13 are angularly spaced from one another.

In the shown example each of the upper portions 18 and 19 has eighteen slots 20 or 21. It is to be understood that this number can be greater or smaller, if necessary.

The stand in the closed position as well as in an open position can not only stand on a supporting surface, but also can be suspended. Two wall hooks suffice to suspend the stand by the upper portion 18 or 19 whereby the wall hooks can engage the upper cross bar 22 or 23 by insertion into the slots 20 and 21. In the suspended condition the stand can be open or closed.

Special hanging means may be also provided, for instance in the upper cross bars 22 or 23, or in the upper end portion of the further bars 41 and 42 or 43 and 44, such as ears, eyelets, tongues and the like.

It will be understood that each of the elements described above, or two or more together, may also find a useful application in other types of constructions, differing from the types described above.

While the invention has been illustrated and described as embodied in a stand for holding utensils to be dried, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stand, particularly for holding utensils to be dried, comprising two plate-like members pivotally connected to one another in a scissors-like manner and pivotable about an axis between an open position so as to assume a rack shape and a closed position, each of said members having an upper portion located above said axis and adapted in said open position to support utensils to be dried, and a lower portion located below said axis and adapted to support the stand in at least said open position, said lower portion of each of said members having a lower end region, a supporting section extending from said lower end region toward said axis and adapted to support utensils to be dried, and a holding section extending from said supporting section in said lower end region at an angle relative to said supporting section so as to prevent utensils supported by said supporting section from sliding off the latter, each of said holding sections being a strip laterally projecting from a respective one of said supporting section so as to form a V-shaped receiving recess therebetween, each of said strips including a substantially right angle with a respective one of said supporting sections and having a lower surface adapted to stably support the stand in an upright manner in said closed position.

2. The stand as defined in claim 1, wherein each of said upper portions is lattice-like and has a plurality of receiving slots extending transverse to said axis and spaced from one another in an axial direction.

3. The stand as defined in claim 2, wherein the slots of one of said upper portions are spaced from one another in said axial direction at locations corresponding to locations at which the slots of another of said upper portions are spaced.

4. The stand as defined in claim 2, wherein each of said slots has two spaced ends, each of said upper portions has two cross bars extending in the axial direction and each bounding said slots at one of said ends thereof, respectively.

5. The stand as defined in claim 4, wherein each of said cross bars includes an upper cross bar and a lower cross bar, each of said supporting sections of each of said members having an upper edge which is spaced from a respective one of said lower cross bars of the same member so that a free space is formed therebetween, one of said members extending through the free space formed in another of said members.

6. The stand as defined in claim 4, wherein said cross bars of each of said upper portions includes an upper cross bar and a lower cross bar; and further comprising means for hanging up the stand in either of said positions and formed in the upper cross bar of the upper portion of at least one of said members.

7. The stand as defined in claim 1, wherein each of said supporting sections of said lower portions has a plurality of holes.

8. The stand as defined in claim 1, wherein said supporting section is a perforated plate.

9. The stand as defined in claim 1, wherein said strip is solid.

10. The stand as defined in claim 1, wherein said strip has a plurality of holes.

11. The stand as defined in claim 1, wherein said supporting section has a lower edge, said V-shaped recess having an inner base line substantially corresponding to said lower edge of said supporting section.

12. The stand as defined in claim 1, wherein said supporting section has a plurality of holes extending at least up to said inner base line of said V-shaped recess.

13. The stand as defined in claim 1, wherein said V-shaped recess has an outer base line located in said lower end region and forming a supporting edge adapted to place the stand onto a supporting surface and to support the stand on said supporting surface in said open position.

14. The stand as defined in claim 1, wherein each of said members is integral.

15. The stand as defined in claim 14, each of said members is constituted by a synthetic plastic material.

16. The stand as defined in claim 1, wherein said upper portions of each of said members has an upper region; and further comprising means for hanging up the stand in either of said positions and formed in the upper region of the upper portion of at least one of said members.

17. A stand, particularly for holding utensils to be dried, comprising two plate-like members pivotally connected with one another in a scissors-like manner and pivotable about an axis between an open position so as to assume a rack shape and a closed position, each of said members having an upper portion located above said axis and adapted in said open position to support utensils to be dried, and a lower portion located below said axis and adapted to support the stand in at least said open position, said lower portion of each of said members having a lower end region, two ends spaced from one another in direction of said axis and two bars each located at a respective one of said axial ends, a supporting section located between said bars and extending from said lower end region toward said axis and adapted to support utensils to be dried, a holding section extending from said supporting section in said lower end region at an angle relative to said supporting section so as to prevent utensils supported by said supporting section from sliding off the latter, two projecting legs each of which including with a respective one of said bars of the same lower portion an angle corresponding to that which is included between said supporting section and said holding section, the latter constituting a strip laterally projecting from a respective one of said supporting section so as to form a V-shaped receiving recess therebetween and extending between the projecting legs of each of said lower portions.

18. The stand as defined in claim 17, wherein each of said legs projects downwardly beyond a respective one of said strips and has a lower surface adapted to be placed on a supporting surface to thereby stably support the stand in an upright manner in said closed position.

19. The stand as defined in claim 17, wherein each of said bars is a flat profile extending up to respective legs and having a thickness measured in direction of said axis.

20. The stand as defined in claim 19, wherein each of said legs is also a flat profile forming an extension of a respective one of said first-mentioned profiles.

21. The stand as defined in claim 19, wherein each of said flat legs has a central plane, each of said strips extending substantially in said central plane of respective legs.

22. The stand as defined in claim 19, wherein each of said flat bars has a lower edge, each of said supporting sections having a lower edge located adjacent to the lower edge of a respective one of said flat bars.

23. The stand as defined in claim 22, wherein said lower edge of each of said supporting sections extends outwardly beyond said lower edge of a respective one of said flat bars.

24. The stand as defined in claim 19, wherein each of said upper portions has two ends spaced from one another in direction of said axis and two further bars each located at a respective one of said axial ends, each of said flat profiles extending through and beyond said axis so as to simultaneously form a respective one of said further bars of said upper portions.

25. The stand as defined in claim 24, wherein each of said upper portions is lattice-like and has a plurality of receiving slots extending transverse to said axis and spaced from one another in an axial direction, each of said slots having two spaced ends, each of said upper portions having two cross bars extending in the axial direction and each bounding said slots at one end thereof, respectively, each of said cross bars extending between respective further bars of a respective one of said upper portions.

26. The stand as defined in claim 25, wherein each of said upper portions has a plurality of partitions extending between said cross bars, each two of said partitions laterally bounding one of said slots.

27. The stand as defined in claim 26, wherein each of said partitions has a width corresponding to a width of a respective one of said further bars.

28. The stand as defined in claim 27, wherein each of said partitions and each of said further bars has two edges spaced from one another in a direction transverse to direction of elongation thereof, each of the edges of each of said partitions being located in a common plane with a respective one of said edges of said further bars.

29. The stand as defined in claim 28, wherein said further bars and said partitions of each of said lower portions has outer regions including an upper cross bar and a lower cross bar, said lower cross-bar of each of said lower portions being connected with said further bars and said partitions of the same lower portion in said outer region thereof.

30. The stand as defined in claim 29, wherein said partitions in the region of said lower cross bar of each of said upper portions are formed as free-standing ribs.

31. The stand as defined in claim 26, wherein each of said partitions has a lower edge which is inclined to a direction of elongation thereof so as to form a bevel.

32. The stand as defined in claim 31, wherein said bevels are so dimensioned and located that in said open position the bevels of the partitions of the upper portions of one of said members abut against the bevels of the partitions of the upper portion of another of said members, so as to form an abutment between said upper portions and thereby between said members.

33. The stand as defined in claim 26, wherein said further bars and said partitions of each of said upper portions of each of said members have inner edges and are outwardly offset relative to respective bars of the same member so that in said closed position the inner edges of the further bars and the partitions of the upper portion of one of said members extends parallel to and abuts against the inner edges of the further bars and the partitions of the upper portion of another of said members.

34. The stand as defined in claim 33, wherein said further bars and partitions are offset by a distance corresponding to a width thereof.

35. The stand as defined in claim 24, wherein each of said flat profiles is Z-shaped in the region of said axis and has a width in said region exceeding a width of a remainder portion thereof.

36. The stand as defined in claim 25, wherein the flat profiles forming said bars and said further bars of the upper portion of one of said members is located axially inside the flat profiles forming said bars and said further bars of the upper portion of another of said members.

37. The stand as defined in claim 36, wherein said flat profiles of one of said members being pivotally mounted relative to said flat profiles of another of said members.

38. The stand as defined in claim 36, wherein each of said cross bars of each of said upper portions includes an upper cross bar and a lower cross bar, said lower cross bar of each of said upper portions of said other member having two axial ends and together with a respective one of said further bars of the same upper portion forming a gap in the region of said axis, each of said further bars of said one member being received in a respective one of said gaps.

39. The stand as defined in claim 38, wherein each of said gaps has an upper end, each of said upper portions having an abutment section upwardly bounding said upper end of a respective one of said gaps and adapted to limit an angle by which said members are pivoted relative to one another to said open position.

40. The stand as defined in claim 24, wherein the further bars of the upper portion of each of said members have upper regions; and further comprising means for hanging up the stand in either of said positions and formed in the upper regions of the further bars of the upper portion of at least one of said members.

* * * * *